United States Patent [19]

Willingham

[11] Patent Number: 4,609,125

[45] Date of Patent: Sep. 2, 1986

[54] WASTE MATERIAL CONTAINER AND CLOSURE FASTENING MEANS

[75] Inventor: T. Donald Willingham, Rock Hill, S.C.

[73] Assignee: General Fabricators, Inc., Rock Hill, S.C.

[21] Appl. No.: 800,044

[22] Filed: Nov. 20, 1985

[51] Int. Cl.[4] ..... B65D 45/16

[52] U.S. Cl. ..... 220/324; 220/1 T; 292/253

[58] Field of Search ..... 220/1 T, 324, 214; 292/253, 307 R

[56] References Cited

U.S. PATENT DOCUMENTS 4,270,668 6/1981 Berfield ..... 220/324

4,371,092 2/1983 Teague ..... 220/324

*Primary Examiner*—George T. Hall

*Attorney, Agent, or Firm*—Shefte, Pinckney & Sawyer

[57] ABSTRACT

A waste material container comprising a receptacle unit, a lid therefor, a resilient gasket interposed between the receptacle unit and the lid, and a locking assembly for holding the lid in place on the receptacle unit. The locking assembly includes an abutment element on the lid, and a locking member mounted for pivotal movement on the receptacle unit, the locking member including a camming surface for engaging the abutment element during such pivotal movement to cause compression of the gasket and including an indenture for receiving the abutment element when the locking member is pivoted to its locked position, with the compressed gasket imposing a bias on the abutment member to maintain it within the indenture at such locked position.

8 Claims, 3 Drawing Figures

WASTE MATERIAL CONTAINER AND CLOSURE FASTENING MEANS

The present invention relates generally to containers having removable lids, and, more particularly, to containers which are used to receive and contain waste materials and which must provide an arrangement for holding the lid in a locked position on the containers for prolonged periods of time.

BACKGROUND OF THE INVENTION

The proliferation of waste materials being generated in large quantities by modern technology, particularly hazardous waste materials and toxic and radioactive materials, have created a need for suitable ways in which such materials can be safely stored for long period of time. One manner of storing such materials is to place them in containers that can be buried, and it is essential that such containers be secured and sealed after they are filled so that the toxic or radioactive materials will not leak from the container during storage. Apart from this essential requirement, the containers must also have a removable lid or top to permit filling of the container before it is stored, and problems have been encountered in designing a container which has a removable lid as well as the capacity for positively securing the lid to the container for long-term storage.

One such container designed for this purpose is disclosed in Teague U.S. Pat. No. 4,371,092 which includes a gasket between the container and the lid, and a bracket attached to the side wall of the container. An L-shaped hold down assembly is provided which has one leg that engages the lid and another leg that slides between the bracket and the side wall of the container, the latter leg being formed with a projection that engages the bracket to retain the hold-down assembly in use. To secure the lid in place, the hold-down assembly member is struck with a heavy object such as a hammer to force the projection through the bracket so that it thereafter is more or less permanently engaged by the bracket. A somewhat similar lid fastener is disclosed in Richardson U.S. Pat. No. 2,918,319 in which a generally L-shaped hold-down member has two legs which engage the lid and a bracket assembly secured to the side wall of the container.

In the general container art, it is also known that flexible or resilient members can be used to engage a lid to hold it in place and selectively permit the lid to be easily removed when necessary. For example, in Berfield U.S. Pat. Nos. 4,270,668 and 4,501,378 a vacuum cleaner container is disclosed in which the lid is held in place by a plurality of buckles formed of molded plastic that can be bent or deformed to engage a portion of the lid. Latching construction of this kind must, of course, be designed to permit the latching element to be easily engaged and disengaged from the lid each time the vacuum cleaner is opened to remove collected dirt, and while these latching constructions are suitable for their intended purpose, they would not be suitable for use in conjunction with the lids of hazardous waste containers because the construction could permit inadvertent removal of the lid during transportion and storage of the waste containers.

In accordance with the present invention a locking assembly is provided which is simple in construction and operation, which is relatively inexpensive, and which provides the required permanent-type hold-down capacity for hazardous waste containers.

SUMMARY OF THE INVENTION

The present invention provides a container for waste material which comprises a receptacle unit for receiving and containing such waste material, the receptacle unit preferably including a bottom wall and side walls extending perpendicularly with respect to the bottom wall, and with the side walls presenting at the extending ends thereof a rim portion at the mouth of the receptacle unit. A removable lid is supported generally at the rim portion of the receptacle unit, and a gasket member is interposed between the lid and the rim portion, such gasket member being formed a resilient material. A locking assembly is provided for locking the lid in place on the receptacle, and comprises an upstanding abutment member secured to the lid, a bracket member secured to the side wall of the receptacle unit, and a locking member having a first end portion formed to engage the bracket for pivotal movement thereabout, a second end portion formed with a camming surface having at least one indenture therein for selectively receiving the upstanding abutment member, and an intermediate portion interconnecting the first and second end portions, such intermediate portion having a predetermined extending length selected to cause said camming surface to engage said upstanding abutment member and press the lid against the gasket member to compress the gasket member during pivotal movement of the locking member about the bracket member, and to cause the locking member to maintain the gasket in compression when the upstanding abutment member is received within the camming surface indenture, whereby the lid is locked in place by the locking member and the compressed gasket member imposes a bias on the lid to maintain the upstanding abutment member within the indenture.

In the preferred embodiment of the present invention, the bracket member is a U-shaped element having the extending leg portions thereof attached to the container side wall and having a base portion disposed in spaced relation to the side wall, and the first end portion of the locking member is hook-shaped to selectively engage the base portion of the bracket member for pivotal movement thereabout. The rim portion of the receptacle unit is preferably a wall portion extending perpendicular and inwardly from the extending end portions of the said side walls, and a reinforcing element is provided to extend between the rim portion and the side wall to provide proper support for the rim portion. The intermediate portion of the locking member preferably comprises a first flat plate extending between the first and second end portions of the locking member, and the second end portion includes a second flat plate extending at an acute angle with respect to the first flat plate and includes a pair of spaced wall portions depending from the side edges of the second plate in generally parallel relation to the first flat plate, with the lower edges of the spaced wall portions being formed as the aforesaid camming surface. Also, the depending wall portions preferably include a second indenture located for engaging the upstanding abutment member at a pre-locking position of the locking member.

DESCRIPTION OF THE PREFERRED EMBODIMENT

Figure 1:
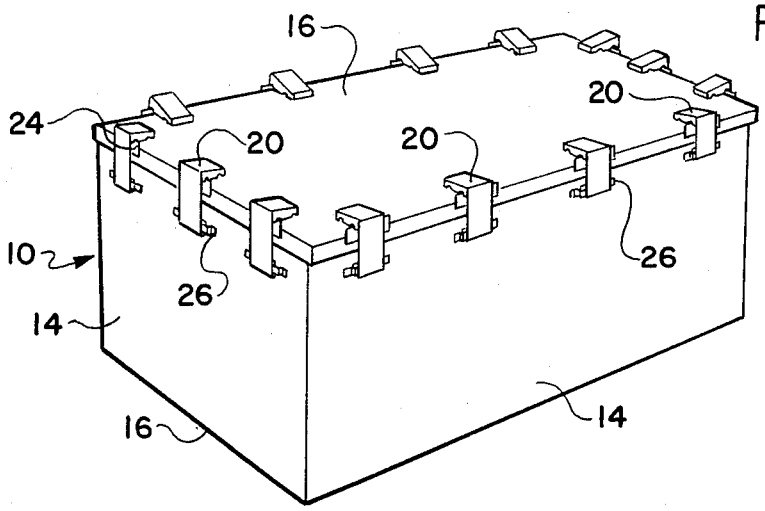
FIG. 1 is a perspective view of a container and lid and locking assembly in accordance with the preferred embodiment of the present invention.

Looking now in greater detail at the accompanying drawings, FIG. 1 shows a typical container of the type used to contain and store hazardous waste materials, which includes a generally rectangularly-shaped receptacle unit 10 having a bottom wall 12 and side walls 14 extending vertically upwardly therefrom, and a lid element 16 disposed across the open top of the receptacle unit 10 to close the receptacle unit after waste materials have been placed therein for storage. As will be described in greater detail below, a gasket member 18 formed of a resilient material, such as rubber, is interposed between the open end of the receptacle unit 10 and the lid 16, and a plurality of locking assemblies 20 are placed at desired locations around the periphery of the receptacle unit 10 to lock the lid 16 in place thereon.

Figure 2:
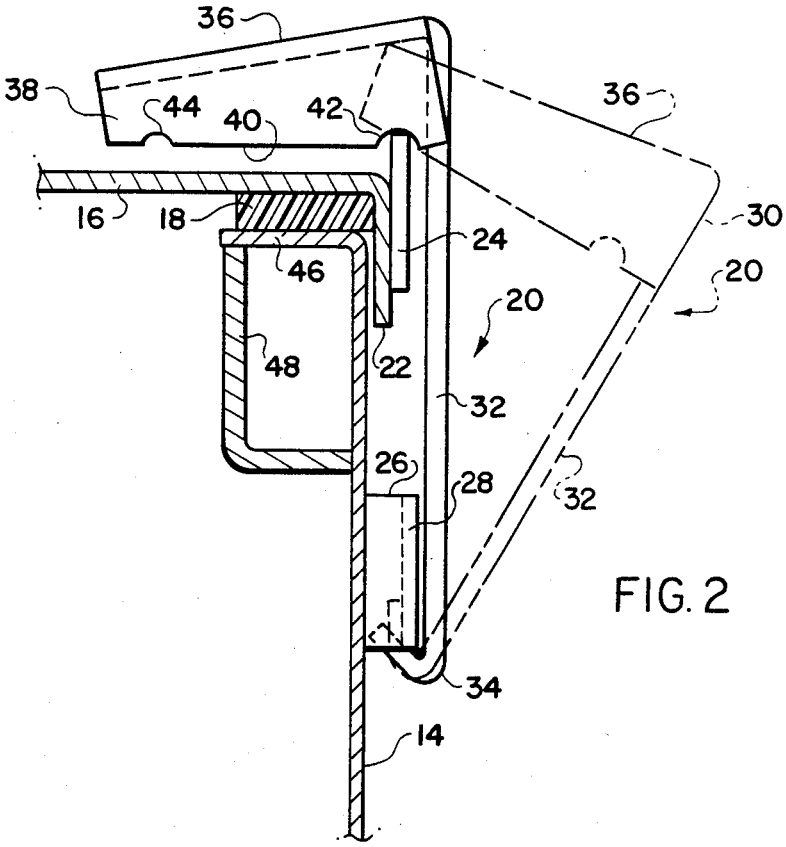
FIG. 2 is a detailed view taken in side elevation of the container, lid, and locking assembly of the present invention.
Figure 3:
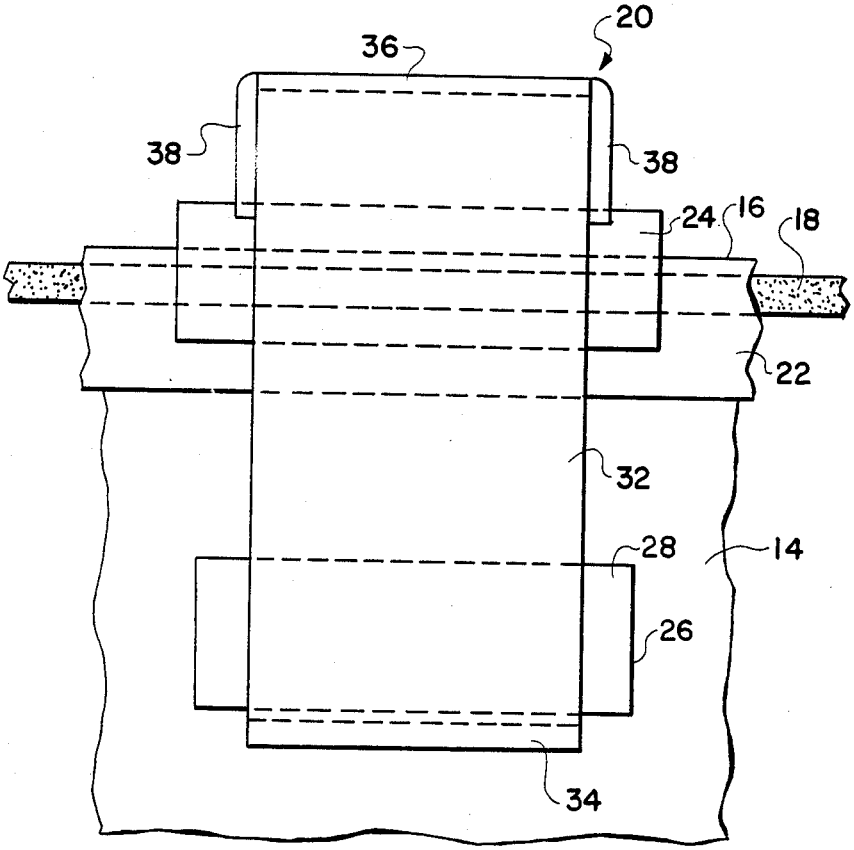
FIG. 3 is a front elevational view of the elements shown in FIG. 2.

Each of the locking assemblies 20 is identical, and one of them is shown in detail in FIGS. 2 and 3. The lid 16 includes a lip 22 that extends downwardly beyond the thickness of the gasket 18 to overlap the side wall 14, and an upstanding abutment element 24 in the form of a relatively thick metal plate is welded or otherwise fixed to the lip 22 so as to project upwardly beyond the top surface of the lid 16. A U-shaped bracket member 26 has extending legs which are welded or otherwise secured to the side wall 14, with the base portion 28 of the bracket 26 being disposed in spaced relation to the side wall 14. A locking member 30 is formed from relatively heavy-gauge metal and includes an intermediate flat plate portion 32 which interconnects a lower end portion 34 that is bent or hook-shaped to engage the base portion 28 of the bracket 26 for pivotal movement thereabout as shown in FIG. 2, and an upper end portion 36 formed by the flat plate being bent at an acute angle with respect to the intermediate wall portion 22. The bent upper end of the flat plate has a width that is greater than the intermediate wall portion 22, and the excess portions are bent downwardly to form a pair of spaced, parallel depending wall portions 38 disposed in planes that are perpendicular to both the intermediate flat wall portion 22 and the upper bent portion thereof. The lower edge of each of the two depending side portions 38 are formed as camming surfaces 40 which have a pair of spaced indentations 42,44 therein, one of the indentations 42 being located adjacent the intermediate wall portion 32 and the other indentation 44 substantially spaced from the intermediate wall portion 32.

As best seen in FIG. 2, the upper edges of the side walls are bent inwardly to provide a rim 46 for supporting thereon the aforesaid gasket member 18, and an angle support element 48 is provided to extend between the rim 46 and the interior surface of the side walls 14 to provide additional support for the rim 46 and permit it to withstand the downward forces imposed thereon.

To use the container and locking arrangement of the present invention, the receptacle unit 10 is filled with waste material, and the lid element 16 is placed over the open end of the receptacle unit 10 with the gasket element 18 interposed between the lid 16 and the inwardly extending rim 46 of the receptacle unit as shown in FIG. 2. The lower end portion 34 of the locking member 30 is then arranged to engage the base portion 28 of the bracket 26, and the locking member 30 is pivoted about the bracket 26 in a counter-clockwise direction as shown in FIG. 2 until the outermost edge of the camming surface 40 engages and slides across the abutment element 24 until the abutment element 24 is received within the outermost indenture 44, whereupon the locking member 30 assumes a pre-locking position as shown by phantom lines in FIG. 2. Because of the short extent of the camming surface 40 outwardly of the indenture 44, very little force is required to pivot the locking member 30 to its free-locking position, and this can generally be done by hand. After the locking member 30 has been located at its pre-locking position, it may then be struck, preferably with a hammer, to cause further counter-clockwise pivoting of the locking member 30 about the bracket 26, and this pivotal movement causes the camming surface 40 to engage and slide across the abutment element 24 until it is received in the innermost indenture 42, whereupon the locking member 30 is in its fully locked position as shown in full lines in FIG. 2. The intermediate wall portion 32 has a predetermined extending length that is selected to cause the camming surface 40, during the aforesaid movement of the locking member 30 between the pre-locked position and the locked position, to engage the upstanding abutment member 24 and press the lid element 16 downwardly against the resilient gasket 18 to cause substantial compression thereof against the rim 46, and, when the abutment element 24 is received within the innermost indenture 42 to cause the gasket 18 to be maintained in sufficient compression to impose an upward bias on the lid 16 which will maintain the abutment element within the indenture 42.

Thus, from the foregoing description it will be apparent that the present invention provides a unique locking arrangement for a waste container which is relatively inexpensive and easy to use. In the latter regard, it will be noted that the mechanical advantage obtained from the wedging action of the camming surface 40 against the abutment element 24 reduces the force that is necessary to obtain a full compression of the gasket 18 during the pivotal movement of the locking member 30. Moreover, because of this full and gradual compression of the gasket, when the locking member 30 is located in its fully locked position, the bias imposed on the lid 16 will provide a significant force to insure that the locking member 30 is maintained in its fully locked position even during handling and transportation of the container, and during the prolonged period of time during which the container may be stored.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. A container for waste material comprising:

(a) a receptacle unit for receiving and containing said waste material, said receptacle unit including side walls and a rim portion defining an opening for receiving said waste material;

(b) a removable lid means supported generally at said rim portion of said receptable unit;

(c) gasket means interposed between said lid and said rim portion, said gasket means being formed of a resilient material; and (d) a locking assembly for locking said lid in place on said receptacle unit, comprising:

(i) an abutment member secured to said lid;

(ii) bracket means secured to said side walls of said receptacle unit; and (iii) locking means having a first end portion formed to engage said bracket for pivotal movement thereabout, a second end portion formed with a camming surface having at least one indenture therein for selectively receiving said upstanding abutment member, and an intermediate portion interconnecting said first and second end portions, said intermediate portion having a predetermined extending length selected to cause said camming surface to engage said abutment member and press said lid against said gasket means to compress said gasket means during pivotal movement of said locking means about said bracket means, and to cause said locking means to maintain said gasket means in compression when said upstanding abutment member is received with said camming surface indenture, whereby said lid is locked in place by said locking means and said compressed gasket member imposes a bias on said lid to maintain said upstanding abutment member within said indenture.

2. A container as defined in claim 1 and further characterized in that said bracket means is a U-shaped element having the extending leg portion thereof attached to said container side wall and having the base portion thereof disposed in spaced relation to said side wall.

3. A container as defined in claim 2 and further characterized in that said one end portion of said locking member is hook-shaped and selectively engages said base portion of said bracket means for pivotal movement thereabout.

4. A container as defined in claim 1 and further characterized in that said container includes a bottom wall and side walls extending generally perpendicularly therefrom, and in that said rim portion comprises a wall portion extending perpendicularly from the extending end portion of said side walls.

5. A container as defined in claim 4 and further characterized in that reinforcing means are provided to extend between said rim portion and a side wall to provide support for said rim portion.

6. A container as defined in claim 1 and further characterized in that said intermediate portion of said locking means comprises a first flat plate extending between said first and second end portions of said locking means, and in that said second end portion comprises a second flat plate extending from said intermediate portion at an acute angle with respect thereto and comprises a pair of spaced wall portions depending from said second plate in generally perpendicular relation to said first flat plate and said second flat plate, the lower edges of said spaced wall portions being formed as said camming surface.

7. A container as defined in claim 6 and further characterized in that said indenture in said camming surface is located thereon adjacent said first flat plate, and in that a second indenture is provided in said camming surface at a location substantially spaced from said first flat plate for engaging said abutment member at a prelocking position of said locking assembly.

8. A container for waste material comprising:

(a) a receptacle unit for receiving and containing said waste material, said receptacle unit including a bottom wall and a plurality of side walls extending in generally perpendicular relation thereto, and a rim wall portion extending in perpendicular relation to said side walls;

(b) a removable lid means extending across the top of said side walls and supported generally at said rim wall portion;

(c) gasket means supported on said rim wall portion and interposed between said rim wall portion and said lid means, said gasket means being formed of a resilient material; and (d) a plurality of locking assemblies for locking said lid in place on said receptacle unit, each said locking assemblies including:

(i) an upstanding abutment member secured to said lid means and extending in generally parallel relation to said side walls of receptacle unit;

(ii) a U-shaped bracket means having the extending leg portions thereof secured to a side wall of said receptacle unit and having the base portion thereof spaced from said side wall; and (iii) locking means comprising a first end portion formed with a hook shape for engaging said base portion of said bracket means for pivotal movement thereabout, a generally flat intermediate portion ending from said first end portion to a second end portion that extends from said intermediate portion at an acute angle thereto and that includes at least one depending wall portion having a bottom edge formed as a camming surface for camming engagement with said upstanding abutment member and formed with an indenture for receiving said upstanding abutment member in the locked position of said locking assembly, said intermediate portion having a predetermined extending length selected to cause said camming surface to engage said upstanding abutment member and press said lid against said gasket means to compress said gasket means during pivotal movement of said locking means about said bracket means and to cause said locking means to maintain said gasket means in compression when said upstanding abutment member is received within said indenture, whereby said lid is locked in place by said locking means and said compressed gasket member imposes a bias on said lid to maintain said upstanding abutment member with said indenture.

* * * * *